US007045748B2

(12) United States Patent
Blackson et al.

(10) Patent No.: US 7,045,748 B2
(45) Date of Patent: May 16, 2006

(54) COOKING APPLIANCE LOCKOUT

(75) Inventors: Chris Ray Blackson, Cottontown, TN (US); Gary Fisher, Goodlettsville, TN (US); James Lewis Ayers, Springfield, TN (US); William Michael Pryor, Portland, TN (US)

(73) Assignee: Electrolux Home Products, Inc., Cleveland, OH (US)

( * ) Notice: Subject to any disclaimer, the term of this patent is extended or adjusted under 35 U.S.C. 154(b) by 0 days.

(21) Appl. No.: 11/093,371

(22) Filed: Mar. 30, 2005

(65) Prior Publication Data

US 2005/0236392 A1 Oct. 27, 2005

Related U.S. Application Data

(60) Provisional application No. 60/558,459, filed on Apr. 1, 2004.

(51) Int. Cl.
*H05B 3/68* (2006.01)
*H05B 3/02* (2006.01)

(52) U.S. Cl. ..... 219/446.1; 219/507

(58) Field of Classification Search ..... 219/445.1, 219/446.1, 448.11, 448.12, 483–486, 501–509
See application file for complete search history.

(56) References Cited

U.S. PATENT DOCUMENTS

| | | | | |
|---|---|---|---|---|
| 4,149,217 | A * | 4/1979 | Tucker | 361/644 |
| 4,511,781 | A * | 4/1985 | Tucker et al. | 219/626 |
| 4,633,067 | A * | 12/1986 | Payne et al. | 219/483 |
| 6,000,390 | A | 12/1999 | Evers et al. | |
| 6,198,080 | B1 * | 3/2001 | Rice et al. | 219/506 |
| 6,255,630 | B1 * | 7/2001 | Barnes et al. | 219/486 |
| 2003/0094448 | A1 | 5/2003 | Shukla et al. | |
| 2004/0069293 | A1 | 4/2004 | Steurer | |

* cited by examiner

*Primary Examiner*—Sang Paik
(74) *Attorney, Agent, or Firm*—Pearne & Gordon LLP

(57) ABSTRACT

A cooking device for cooking an item where the device includes an input for a source of cooking energy; a cooking element for applying the cooking energy to the item; a cooking control for controlling the application of the cooking energy to the item; a lockout selectable for preventing application of the cooking energy to the cooking element, the lockout being non-selectable when the cooking control is activated; and a user interface, the interface providing an indication of selection of the lockout in response to a user attempt to activate the cooking control when the lockout is selected.

10 Claims, 3 Drawing Sheets

COOKING APPLIANCE LOCKOUT

BACKGROUND OF THE INVENTION

1) Field of the Invention

The present invention relates to cooking appliances and, in particular, to cooking appliance controls.

2) Description of Prior Art

Electric and gas stoves using electric or gas heating elements are popular consumer appliances for home cooking uses. However, such consumer devices are used in locations that may have children, or other persons that should not operate cooking appliances.

A consumer-friendly lockout device for allowing a user to make a cooking or heating appliance inoperative by unauthorized persons would be useful. However, when an appliance has been deactivated, a problem arises that an unauthorized person may have tried to activate the appliance when the device is preventing such activation, but leaving one or more of the appliance controls in an "activated" condition. If the appliance controls remain in an activated state, operating the lockout device to re-activate the appliance could lead to a situation where the appliance is unexpectedly activated by the user, perhaps without the user's knowledge. A means for preventing such unauthorized activation, and/or a means for notifying the user of such a problem, would be useful.

Also, a lockout device might be inadvertently or improperly activated while the appliance is in use. A means of preventing, and/or notifying of, such improper or inadvertent use of the device to avoid potential interruption of the appliance use (such as cooking) would be beneficial.

Further, because more and more appliances are using microprocessor and/or controller control, it would be useful for a lockout device to communicate its states to, and receive state information from, such a processor/controller to allow coordinated operation with other appliance features and perhaps to allow multiple activation/deactivation sources.

Even further, it would be useful for a lockout device to provide notification to a user of the above described conditions and operating states, among other useful notifications.

SUMMARY OF THE INVENTION

In accordance with one aspect, the present invention provides a cooking device for cooking an item where the device includes an input for a source of cooking energy; a cooking element for applying the cooking energy to the item; a cooking control for controlling the application of the cooking energy to the item; a lockout selectable for preventing application of the cooking energy to the cooking element, the lockout being non-selectable when the cooking control is activated; and a user interface, the interface providing an indication of selection of the lockout in response to a user attempt to activate the cooking control when the lockout is selected.

DESCRIPTION OF EXAMPLE EMBODIMENTS

Figure 1:
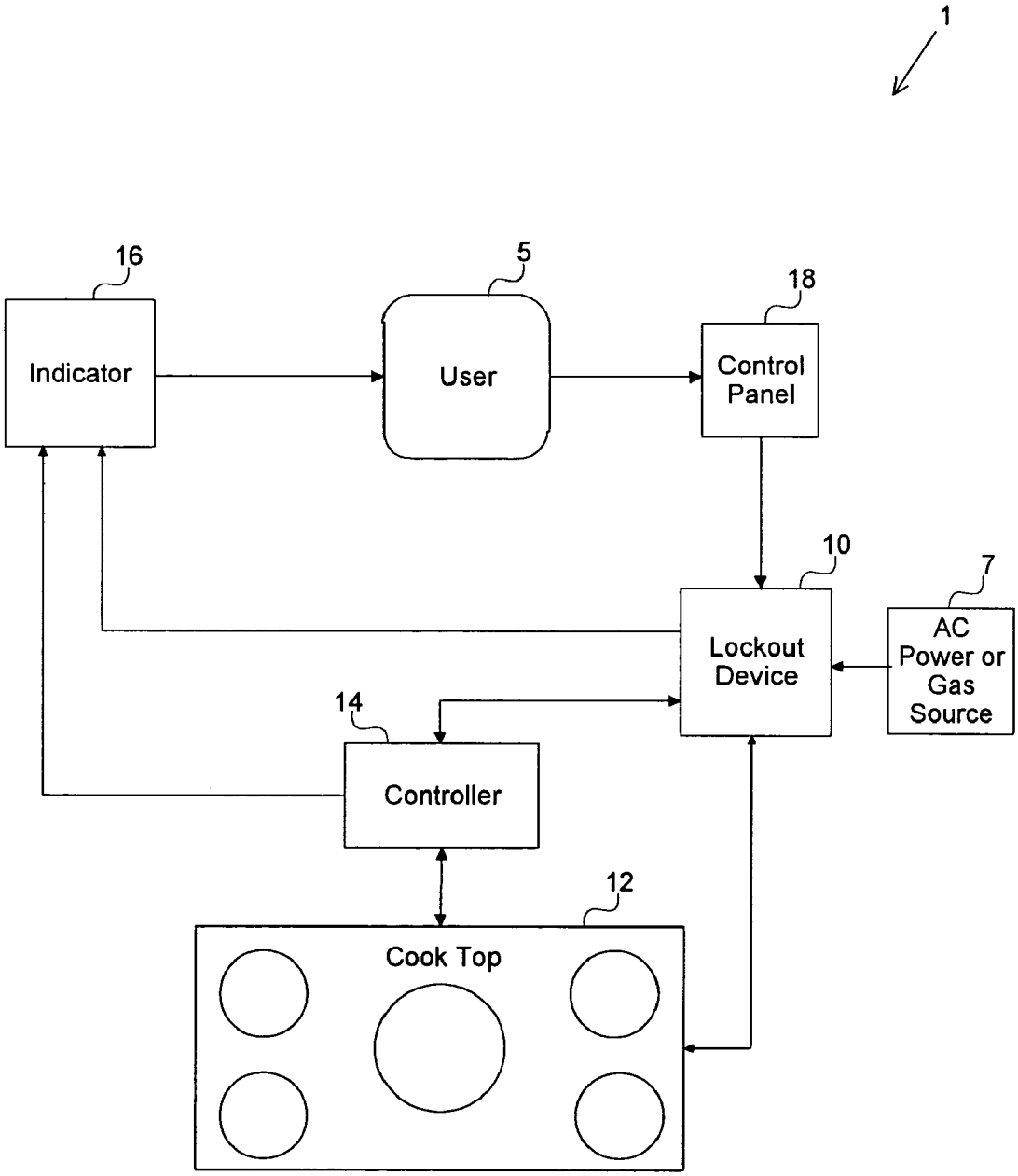
FIG. 1 is a block diagram of an example device according to an aspect of the invention.

Referring to FIG. 1, a cooking device 1 includes a lockout 10 connected to a cooktop 12 (having a number of surface cooking elements, e.g., 5). The device 1 is further connected to an indicator 16 and a control panel 18, together forming a users interface for a user 5. The user 5 can activate the lockout device 10 via the control panel 18, and an indication is provided on either the separate indicator 16, or on the control panel 18. The indicator 16 provides status information to the user 5. The controller 14 monitors the status of the device 1, including the lockout 10, and may also activate/deactivate the lockout 10, in particular, or the device 1, in general, depending on its control logic. The lockout 10, when properly set to lockout the cooktop 12, prevents the AC power (electric cooktop) or gas supply (gas cooktop) 7 from powering the cooktop 12, under the conditions described herein. For a gas appliance, the lockout 10 can include, for example, an electrically operated valve (e.g., solenoid or motor driven). For an electric appliance, the lockout 10 can include a switch capable of interrupting several thousand watts. The controller 14 and any desired logic in the lockout 10 can be easily implemented, for example, with microprocessor, microcontroller, programable arrays and the like along with typical support circuitry. One of the advantages of the present invention is that in terms of the logical portion it may be used in both gas or electric appliances.

It can be readily understood that the example of a cooktop is merely for aid in understanding an aspect of the invention and other cooking devices are all within the scope of the invention, for example, ranges, ovens, broilers, fryers, rotisseries, and so on, whether the energy source is electric, combustible gas, steam, or other suitable energy source.

Figure 2:
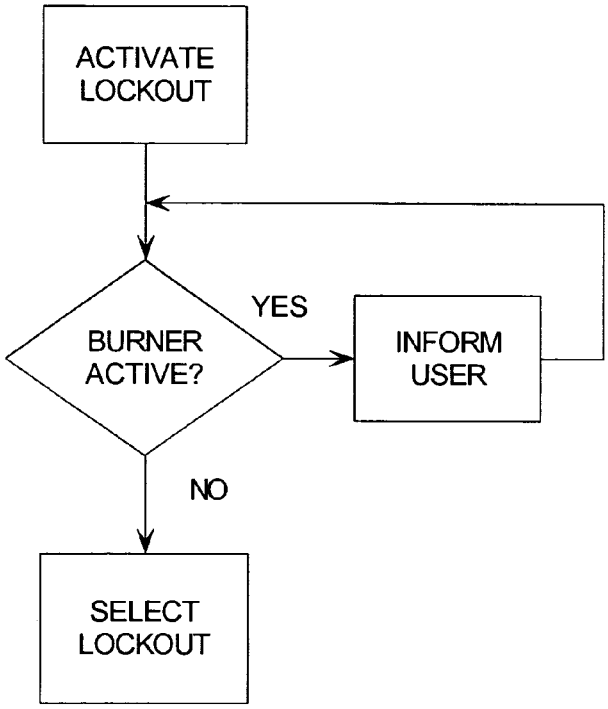
FIG. 2 is an example flowchart.

Referring to FIG. 2, an example of a possible mode of operation of the lockout is illustrated. When a user tries to activate the lockout, the logic (which may be located within the controller 14, the lockout 10 itself or divided between the two) checks to see if any of the cooking elements are activated. If yes, lockout cannot be selected and an indication of this is provided to the user. If no, lockout is selected. The indications to the user may be, for example, an audio signal, a visual signal, or both.

Figure 3:
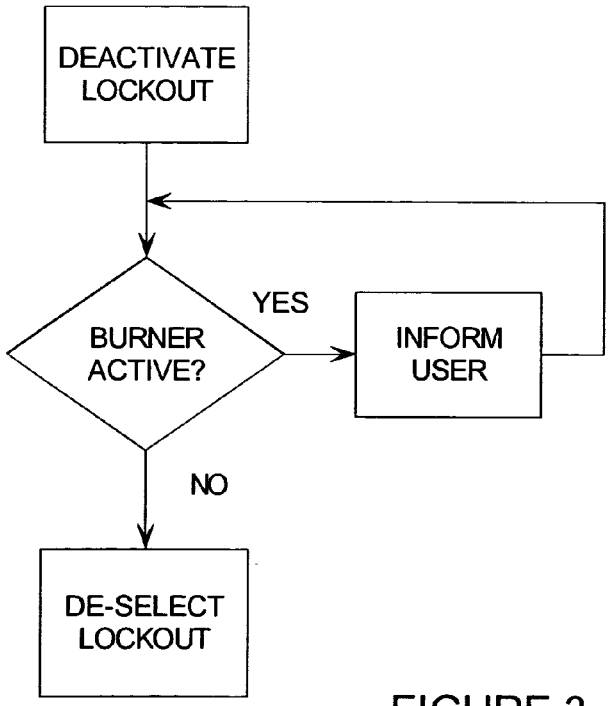
FIG. 3 is another example flowchart.

Referring to FIG. 3, an other example of a possible mode of operation of he lockout is illustrated. If lockout is selected and a user tries to deactivate it, the logic checks to see if any cooking elements are in an activated state. If yes, lockout cannot be de-selected and an indication of this is provided to the user. If no, lockout is de-selected.

What is provided, for example, is a user operable device for cutting AC Power or gas to one or more cooking elements. The device also supports lockout commands derived from different sources, including, for example, a contact closure (door motor contacts), or from a dedicated control module command. In one example of the device, the device may be configurable with common artwork for either electric or gas applications.

The device may also provide, for example, control indication signals to a micro-controller system, indicating cooking device activity. Control software can use the indications to warn the user (with audio and/or visual warning signals, for example) if the following conditions occur:

a) If the user requests cooking device activity when in lockout mode, an indicator will activate. In this condition, if the user attempts to abort lockout mode, the corresponding electronic control will not implement the user request (and thus not activate the cooking device), and will continue to warn the user of the condition.

b) If the user requests lockout mode when currently implementing cooking device functions, the same or a different indicator will activate. With this condition, the corresponding electronic control will, for example, not implement the lockout request to allow the cooking process to continue.

The device may also provide a positive feedback indication signal to the micro-controller system, indicating whether the system is in lockout mode.

Further, the device, for example may be capable of breaking AC power (if electric appliance) or breaking the gas feed (for gas appliance) to five or more cooktop elements. The worst case power to each element can be 3000 or more watts that should be interruptible.

When in a failure mode, the lockout should fail by providing AC power or gas (where applicable) to the cooking device elements to allow the appliance to be usable. The lockout should also provide an indication to the controller of the condition. An indication signal can inform the user of the failure condition.

In some cases, it is useful if the lockout state is stored in non-volatile memory to enable the state to be re-established after a temporary removal of power.

In the case of an electric cooking device, it is relatively easy to determine the state of the device. In a gas cooking device further measures may be useful.

Figure 4:
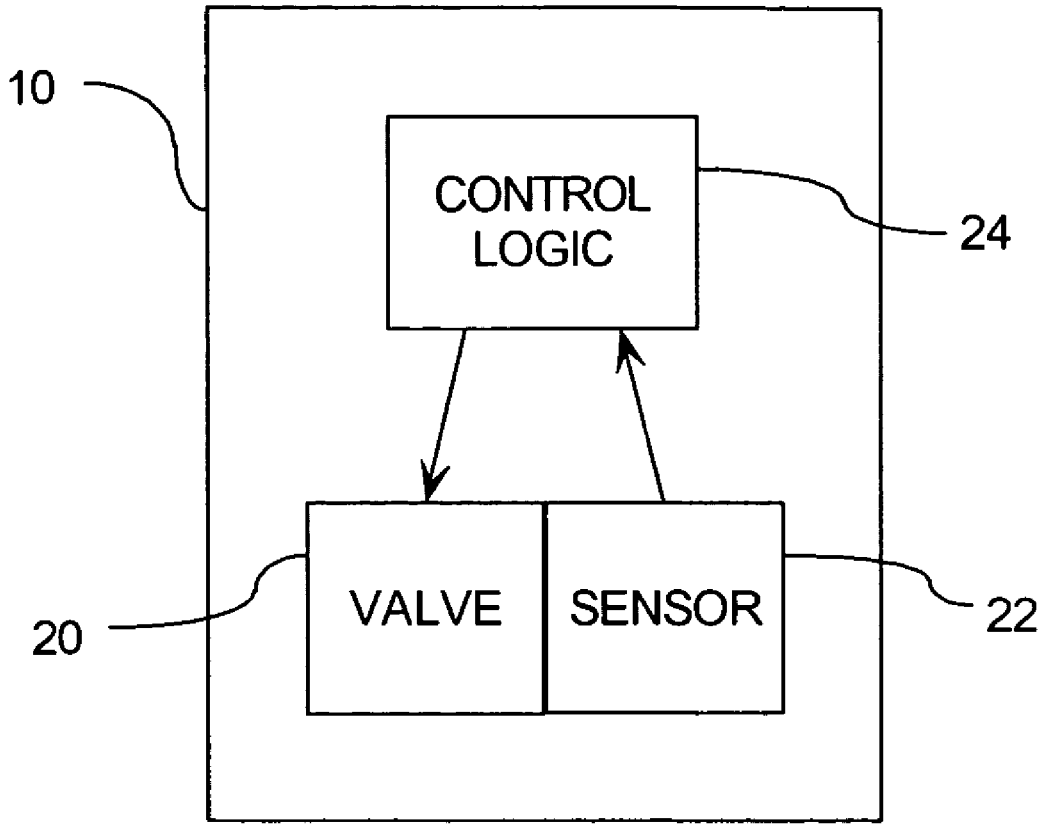
FIG. 4 is a block diagram of an example of a portion of gas lockout.

Referring to FIG. 4, an electrically operated gas valve 20 in a lockout 10 may include a valve position sensor 22. The sensor 22 may be, for example, a switch responsive to the valve position (e.g, open or closed). The sensor 22 then provides valve position information to the control logic 24. For example, the logic may require that the valve change from one position to the other within a desired range of time, otherwise a fault can be assumed to have occurred. The control logic 24 may be, for example, co-located with the lockout 10 or implemented within the controller 14.

In the case of a gas cooking device, it may also be useful to provide the heating element valves with position sensors to provide electrical signals representative of the valve state.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A cooking device for cooking an item, said device comprising:

an input for a source of cooking energy;

a cooking element for applying the cooking energy to said item;

a cooking control for controlling the application of said cooking energy to said item;

a lockout selectable for preventing application of said cooking energy to said cooking element, said lockout being non-selectable when said cooking control is activated; and a user interface, said interface providing an indication of selection of said lockout in response to a user attempt to activate said cooking control when said lockout is selected.

2. A device according to claim 1, wherein if the cooking control is selected while the lockout is activated, said lockout cannot be de-selected until said cooking control is de-selected.

3. A device according to claim 2, wherein said interface provides an indication of an attempt to de-select said lockout while said cooking control is activated.

4. A device according to claim 1, wherein in the event of a failure of said lockout, said lockout will permit application of said cooking energy to said cooking element and said interface will provide an indication of said failure.

5. A device according to claim 1, wherein said indication is by an audio signal.

6. A device according to claim 1, wherein said indication is by a visible signal.

7. A device according to claim 1, wherein said energy source is electricity, said cooking control is an electric control and said lockout includes a switch to interrupt said electricity.

8. A device according to claim 1, wherein said energy source is a combustible gas, said cooking control includes a valve and said lockout includes a valve to interrupt said gas.

9. A device according to claim 8, further including a lockout valve position sensor, wherein upon a lockout selection or de-selection, a lockout selection position or a lockout de-selection position, respectively, must be sensed by said sensor within a desired time range.

10. A device according to claim 1, wherein said lockout is selectable by at least one of a user, a door sensor or a controller in the device.

* * * * *